United States Patent [19]

Kronogård

[11] 4,183,209

[45] Jan. 15, 1980

[54] GAS TURBINE GUIDE APPARATUS

[76] Inventor: Sven-Olof Kronogård, Karstorpsvagen 31, Lomma, Sweden

[21] Appl. No.: 834,918

[22] Filed: Sep. 20, 1977

[30] Foreign Application Priority Data

Sep. 24, 1976 [SE] Sweden ..... 7610576

[51] Int. Cl.[2] ..... F02D 3/10; F01B 9/02

[52] U.S. Cl. ..... 60/39.16 R; 415/161

[58] Field of Search ..... 60/39.16 R, 39.16 SI; 415/148, 151, 155, 159, 160, 161

[56] References Cited

U.S. PATENT DOCUMENTS

| | | | |
|---|---|---|---|
| 3,167,914 | 2/1965 | Savonuzzi | 60/39.32 |
| 3,498,057 | 3/1970 | Kronogård et al. | 60/39.16 SI |

FOREIGN PATENT DOCUMENTS

| | | | |
|---|---|---|---|
| 34044 | 4/1908 | Austria | 415/161 |
| 1303779 | 8/1962 | France | 415/161 |
| 908047 | 10/1962 | United Kingdom | 415/161 |

*Primary Examiner*—Louis J. Casaregola
*Attorney, Agent, or Firm*—Cantor and Singer

[57] ABSTRACT

In a gas turbine power plant including a separate power turbine, a guide apparatus located downstream of the power turbine rotor will have to cope with gas flows varying considerably with respect to velocity and inlet direction. To provide improved flow handling properties the individual vanes of the guide apparatus are divided, and comprise a stationary portion extending over the full axial depth of the vane, and a smaller portion, including part of the thicker nose of the vane only. This smaller portion is displaceable in relation to the stationary portion, so the vane, when its portions are brought together, presents a rounded front edge, and, in the displaced position of the portions, presents a sharp front edge.

7 Claims, 5 Drawing Figures

GAS TURBINE GUIDE APPARATUS

BACKGROUND OF THE INVENTION

Gas turbines, operating under highly varying speed and load conditions, such as in automotive plants including a separate power turbine, are often provided with a guide apparatus comprising adjustable guide vanes. Such vanes are especially important in turbines having several rotors mounted upon separate shafts, being interconnected to permit power transfer, and fed with gas from a common producing unit. An adjustment of the guide vanes will make possible a distribution of power between the individual rotors. A disadvantage of most known designs of adjustable guide vanes is, that an adjustment of the vane will bring about an alteration of the angle of entrance, as well as of the angle of exit, which sometimes is undesirable.

SUMMARY OF THE INVENTION

According to the invention it is now proposed, that the individual guide vanes are formed in a novel manner with respect to flow handling properties, and comprise a first stationary portion and a second portion being displaceable in relation to the first portion.

The individual guide vanes have a basically airfoil section including a thick nose part adjacent to a leading edge of said profile and merging into a tapering tail part, terminated by a trailing edge. Each vane is divided along a plane through said nose part to define a first portion, being stationary with respect to the guide apparatus and extending from said leading edge to said trailing edge, as well as a second portion extending through said thick nose part only, and means are provided to change the position of said second portion in relation to said first portion.

The movable portion may be formed as a semi-cylinder being rotably mounted in relation to a matching recess in the stationary part, or it may be formed as a slice of the thick nose part of the profile, being displaceable peripherally or axially in relation to the stationary portion.

DESCRIPTION OF SOME PREFERRED EMBODIMENTS

Figure 1:
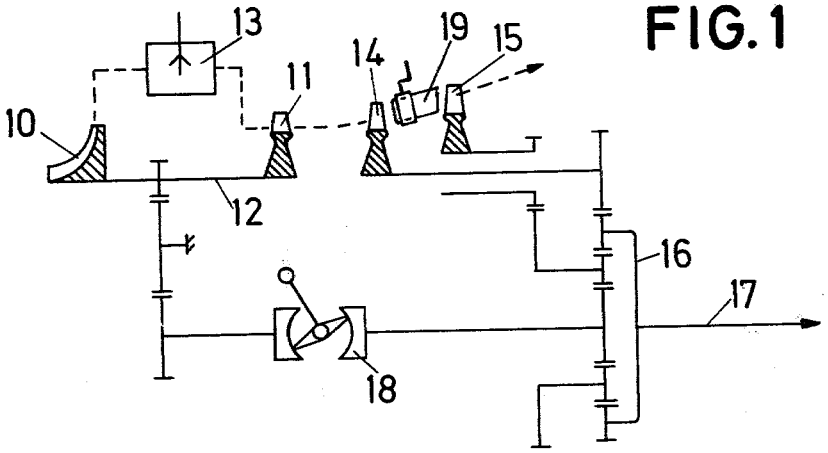
FIGS. 1–2 schematically show different arrangements of 2- and 3-shaft automotive turbines, provided with adjustable guide vanes, according to the invention.

The plant shown in FIG. 1 comprises a gazifier portion including a compressor 10, a first turbine rotor 11 mounted upon the same shaft 12 as the compressor, and a combustor 13.

The combustion gases issuing from the latter pass turbine rotor 11 and two further turbine rotors 14 and 15. Of those, rotor 14 is the power turbine proper, and is by way of a planetary gearing 16 connected to a power take-off shaft 17. The third turbine rotor 15 is connected to planetary gear 16, at the planetary gear carrier thereof.

The sun wheel of the planetary gearing is connected to shaft 12 by way of an infinitely variable transmission 18. This arrangement makes possible utilization of rotor 15, for driving at the power take-off shaft 17, as well as for augmenting the compressor drive. The latter function is possible even if power take-off shaft 17, and thus rotor 14, should occasionally be braked. In this manner it is possible rapidly to accelerate the gazifier portion. In order to facilitate the distribution, during varying load conditions, of power between the turbine rotors 14, 15 the turbine is provided with adjustable guide vanes 19 (of the type to be described in conjunction with FIG. 3). Contrary to conventional practice these vanes are not rotatable over their full axial depth, but include a stationary as well as a movable portion. The figure is exaggerated in order, in a simple manner, to illustrate the operation of the movable vane portion.

Figure 2:
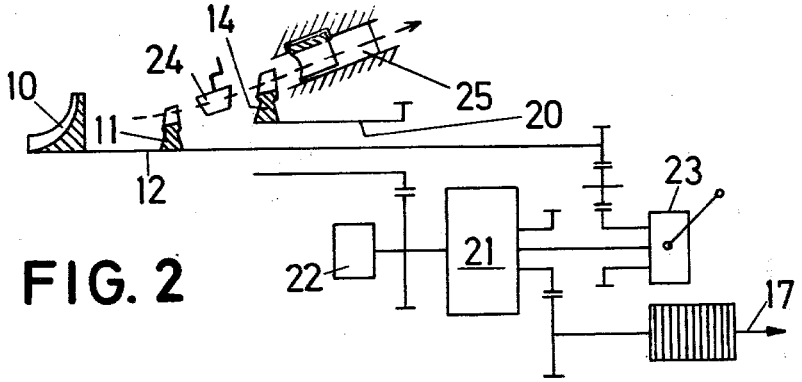

The plant according to FIG. 2 contains mainly the same components as that of FIG. 1, and the same reference numerals are used, whenever applicable.

There are two rotors 11 and 14, respectively. Turbine shafts 12 and 20 are interconnected by means of a gearing 21 (of arbitrary kind, not illustrated in detail), from which the power take-off shaft 17, as well as auxiliaries 22 are driven. Between gearing 21 and shaft 12 there is an infinitely variable transmission 23. The gearing may be hydrodynamic, aerodynamic or hydrostatic. Both plants may be provided with a heat exchanger (not shown) for recovering heat from the exhaust gases.

With the embodiment there is a conventional, adjustable guide vane 24 between rotors 11 and 14 the divided guide vanes 25 according to the invention form part of an outlet stator located downstream of the single power turbine rotor 14. The vanes are here basically of a type to be described in conjunction with FIG. 4. The leading edge of the nose portion is notched to present a U-, or V-shaped profile to the on-flowing gases, to make possible a better adaptation to high Mach numbers and big variations in the angles of entrance of the gases.

These embodiments have been used to illustrate possible locations and use of the adjustable guide vanes, and must not be interpreted as limiting the scope of the invention.

The number of rotors in the gas turbine may vary, and, when three or more rotors are included, a guide apparatus may be fitted between any pair of two consecutive rotors.

As is known in the art the vanes may be manufactured from metallic, ceramic or composite materials, and may be solid, or formed as thin shell structures. The vanes may further be provided with passages to permit the flow of a cooling fluid, such as air. A man skilled in the art knows how to select such materials and basic shaping, so they are not described in detail here.

Figure 3:
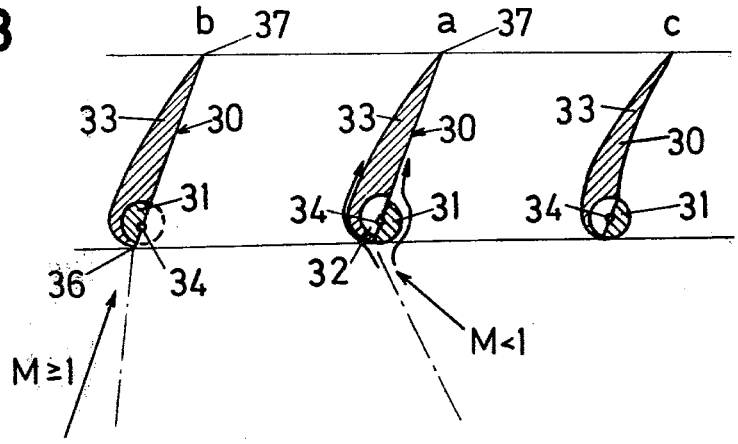
FIGS. 3–5 show different forms of divided guide vanes.

If the direction of entrance, as well as the velocity of the on-flowing gas is expected to vary considerably during varying operating conditions, a vane as shown in FIG. 3 will provide a cheap and simple solution, suitable in many installations.

The vane profile 30 has a basically airfoil section with a rather full front part, which is exaggerated in the drawing. The front part includes a rotatable semi-cylinder 31, or any similar geometric body, which is mounted in conjunction with a mating recess 32 in the stationary, main body 33 of the vane. This has a substantially plane pressure side, extending from the leading edge 36 of the profile to the trailing edge 37 thereof, respectively, and an arched suction side. It should be noted that this design can be used also with slim and very small vane profiles, where a variable geometry would otherwise be impossible.

With low Mach numbers, $M << 1$, and a considerable deflection of the on-flowing gas, movable member 31 is brought to the position shown in FIG. 3*a*. The axis of rotation 34 of member 31 is excentrically located with respect to the geometric axis of recess 32, whereby the profile, in the position shown in FIG. 3*a*, will obtain a smooth front edge to present towards the gas flow. The clearance appearing at the downstream edge of member 31 is acceptable.

Alternatively the leading edge of profile 33 may be modified, as shown in FIG. 3*c*, in which the member is a semicylinder, concentric with the recess, and the face of the stationary portion extending downstream of the recess is slightly concave.

When high inlet velocities, $M \geqq 1$ is expected, member 31 is rotated, so it is concealed within the main body of the profile, as shown in FIG. 3*b*. The guide vane should preferably be designed so its plane pressure side substantially coincides with, or provides a slight positive angle of incidence with respect to the direction of entrance of the gases during high Mach number flow.

Figure 4:
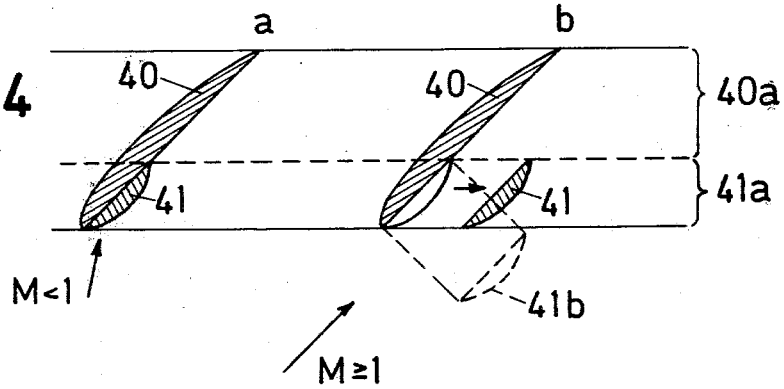
Figure 5:
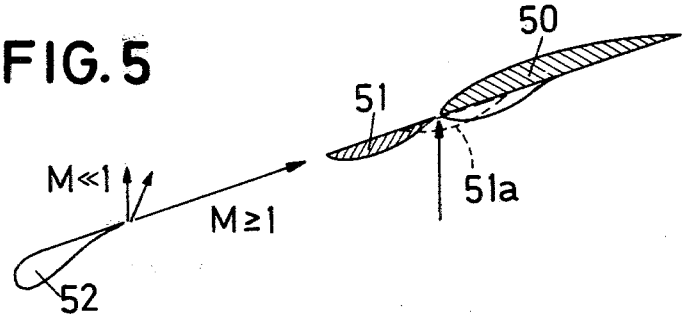

FIGS. 4 and 5 show modifications of the same basic idea as is shown in FIG. 3, but here the movable inlet portion is displaceable, instead of rotatable.

The profiles are divided along a plane being substantially parallel to the longitudinal direction of the vane, and the movable portion may be displaced peripherally, or axially, or along a path being a combination of those two directions.

FIG. 4*a* shows a vane profile of conventional type, having a full front portion. The vane is divided along a plane, being parallel to the longitudinal direction of the vane, and will consist of a stationary, main portion 40, which extends over the full depth of the vane, and a movable portion 41, which includes the remainder of the thicker front portion of the vane.

The main portion 40 will, same as with the embodiment according to FIG. 3, obtain an arched suction side and a plane pressure side, and the vane is mounted so the pressure side will coincide with the direction of entrance of the gases during high Mach number flow ($M \geqq 1$).

Also portion 41 will thus show a plane side coinciding with the direction of the gases.

In this manner it is possible to obtain either a double-grid stator, having a pointed inlet profile, suitable for high Mach numbers, or, by moving the portions of the vanes together, a low-velocity profile having a rounded inlet edge being less sensitive to variations in the direction of entrance of the gases.

FIG. 5 largely corresponds to the embodiment according to FIG. 4. Here, however, the movable portion 51 is adapted to be displaced forwards in relation to the stationary portion 50, against the direction of the on-flowing gas. The displacement is preferably selected so the movable portion will be located just ahead of the stationary portion. A preceeding rotor vane; in either of rotors 11 or 14, is denoted by 52, and arrows issuing from its trailing edge will indicate the direction of entrance of the gas into the stator structure as well as the mangitude of the velocity. Where the axial distance to the preceeding rotor is short, a partial displacement, resulting in an overlapping position, as indicated by dotted lines at (51*a*), may be accepted.

With low gas velocities $M << 1$ the portions, when brought together, will present a rounded leading edge, while with separated portions at high Mach numbers, $M \geqq 1$, sharp leading edges are obtained.

The movable portions 41 (or 51, respectively) may be interconnected or formed (for instance cast) integral with an inner and/or outer ring, denoted by 41*a* in FIG. 4. This may be rotated by means of a servomotor, or any other suitable means governed by the control system of the turbine. Ring 41*a*, and the vane portions mounted thereon, may thus be moved tangentially (a rotating movement), or axially (a linear movement), or along a path being a combination of these two movements, (a helical movement indicated by 41*b*).

With these embodiments the leading edge of the vanes may be arranged inclined in the direction of the on-flowing gas, possibly to present a U- or V-shaped contour, which is favourable with respect to the shock and vibration withstanding properties.

What I claim is:

1. An automotive gas turbine plant including at least one power turbine rotor and a gasifier portion operable independently of the power turbine rotor, and further including a guide apparatus comprising a number of guide vanes and means to mount the same in a substantially radial position in a gas flow passage, downstream of said at least one power turbine rotor with reference to the direction of flow of the combustion gases from the gasifier, each vane having a basically airfoil section including a thick nose part adjacent to a leading edge of its profile and merging into a tapering tail part, terminated by a trailing edge, each vane being divided along a plane passing through said nose part to define a first portion, being stationary with respect to the guide apparatus and extending from said leading edge to said trailing edge, as well as a second portion extending through said thick nose part only and means to change the position of said second portion in relation to said first portion.

2. The guide apparatus, according to claim 1 in which said second portion is formed substantially as a semicylinder, and the first portion is provided with a mating recess, means being provided to rotatably mount said second portion in conjunction to said recess.

3. The guide apparatus according to claim 2, in which the axis of rotation of said second portion is located excentrically with respect to the geometric axis of said recess, whereby the movable portion, in outwardly turned position, together with the leading edge of said first portion presents a smooth, rounded front edge.

4. The guide apparatus according to claim 1 in which the means for changing the position of said portion is adapted to displace said second portion peripherally in relation to said first portion.

5. The guide apparatus according to claim 1 in which the means for changing the position of said second portion is adapted to displace said second portion obliquely (in a helical path) forwards from said first portion, against the direction of the on-flowing gases.

6. The guide apparatus according to claim 1, in which the means for changing the position of said second portion is adapted to displace said second portion along a straight line, forwards from said first portion, against the direction of the on-flowing gases.

7. The guide apparatus are the claim 1 in which the plane of division is selected so as to form a plane surface at said first portion, extending from said leading edge to said trailing edge.

* * * * *